US009784541B1

(12) United States Patent
Genson et al.

(10) Patent No.: US 9,784,541 B1
(45) Date of Patent: Oct. 10, 2017

(54) INCREASED LETHALITY WARHEAD FOR HIGH ACCELERATION ENVIRONMENTS

(71) Applicant: The United States of America as Represented by the Department of the Navy, Washington, DC (US)

(72) Inventors: Kevin Genson, Waldorf, MD (US); Edward Lustig, Charlotte Hall, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/330,138

(22) Filed: Aug. 15, 2016

(51) Int. Cl.
*F42B 12/32* (2006.01)
*F42B 12/24* (2006.01)
*F42B 12/20* (2006.01)

(52) U.S. Cl.
CPC ..... *F42B 12/24* (2013.01); *F42B 12/207* (2013.01); *F42B 12/208* (2013.01)

(58) Field of Classification Search
CPC .. F42B 1/00; F42B 12/00; F42B 12/02; F42B 12/72
USPC ..... 102/473, 478, 491, 493, 495
See application file for complete search history.

(56) References Cited

U.S. PATENT DOCUMENTS

| | | | | |
|---|---|---|---|---|
| 6,962,634 | B2 | 11/2005 | Nielson et al. | |
| 7,307,117 | B2 | 12/2007 | Nielson et al. | |
| 7,614,348 | B2 | 11/2009 | Truitt et al. | |
| 7,752,972 | B1 | 7/2010 | Baker et al. | |
| 7,886,668 | B2 | 2/2011 | Hugus et al. | |
| 7,955,451 | B2 | 6/2011 | Hugus et al. | |
| 8,033,223 | B2 | 10/2011 | Sheridan et al. | |
| 8,250,985 | B2 | 8/2012 | Hugus et al. | |
| 8,250,986 | B1 | 8/2012 | Sheridan et al. | |
| 8,387,535 | B1 | 3/2013 | Guirguis et al. | |
| 8,746,145 | B2 | 6/2014 | Hugus et al. | |
| 8,894,783 | B2 | 11/2014 | Dixon et al. | |
| 8,973,503 | B2 | 3/2015 | Dunaway et al. | |
| 9,103,641 | B2 * | 8/2015 | Nielson | C06B 45/00 |
| 9,541,363 | B2 * | 1/2017 | Burky | F42B 12/22 |
| 9,683,822 | B2 * | 6/2017 | Kerns | F42B 12/34 |
| 2009/0308272 | A1 * | 12/2009 | Schroeder | F42B 12/06 102/364 |
| 2010/0199875 | A1 * | 8/2010 | Weihrauch | F42B 12/208 102/492 |

* cited by examiner

*Primary Examiner* — J. Woodow Eldred
(74) *Attorney, Agent, or Firm* — Fredric Zimmerman

(57) ABSTRACT

A warhead device of an ordnance including a body of a high strength material, where the body includes a plurality of depressions; an explosive material, where the explosive material fills the body; and a plurality of reactive materials, where each reactive material fills a corresponding depression of the plurality of depressions on the body. The high strength material is configured to endure an internal stress, a first stress caused by the plurality of reactive materials, and a second stress caused by another component of the ordnance. The internal stress, the first stress, and the second stress are in response to acceleration of the ordnance.

20 Claims, 6 Drawing Sheets

INCREASED LETHALITY WARHEAD FOR HIGH ACCELERATION ENVIRONMENTS

GOVERNMENT INTEREST

The embodiments described herein may be manufactured, used, and/or licensed by or for the United States Government without the payment of royalties thereon.

BACKGROUND

Technical Field

The embodiments herein relate to weapons and more particularly to ordnance warheads.

Description of the Related Art

Existing munitions primarily rely on the detonation of an explosive to fragment and project a solid metal body (typically steel) towards a target. The interaction of the fragments and the target may lead to destructive effects that destroy or disable the target. Conventional warheads use inert materials that contribute no additional energy to the effect; the destruction of the target is exclusively dependent on the energy imparted on the fragment by the detonating explosive.

Lethality may be a function of the number of fragments projected, the area of the target that is vulnerable to damage from those fragments, and the probability that a fragment impacting that vulnerable area will cause the desired destructive effect. Consequently, the lethality may be dependent on the nature of the target and the impact area of the fragment on the body of the target.

The vulnerable area of a target may be limited to critical components or compartments of the target, and fragments that do not strike these vulnerable areas may not play a meaningful role in the destruction of the target. An example of this effect can be seen in fragments impacting a light vehicle such as a truck. Only fragments that strike critical areas such as the engine block or crew compartment may be relevant to the act of destroying or disabling the vehicle. If the fragments are inert, the fuel tanks of a vehicle are typically not considered part of the vulnerable area; a steel fragment will not ignite the fuel tank and may not cause a significant loss of fuel.

SUMMARY

In view of the foregoing, an exemplary embodiment herein provides a warhead device of an ordnance, the device including a body comprising of a high strength material, where the body includes a plurality of depressions; an explosive material, where the explosive material fills the body; and a plurality of reactive materials, where each reactive material fills a corresponding depression of the plurality of depressions on the body, where the high strength material is configured to endure an internal stress, a first stress caused by the plurality of reactive materials, and a second stress caused by another component of the ordnance, where the internal stress, the first stress, and the second stress are in response to acceleration of the ordnance.

The warhead device may further include a shock attenuating layer including a material configured to mitigate a shock effect, associated with detonating the explosive material, on the body. Each of the plurality of depressions may include a geometrical shape including any of a circular, square, and rectangular shape. The plurality of depressions may be arranged in a pattern configured to maximize a fragment distribution of the body. The plurality of depressions may be arranged in a pattern configured to minimize a stress on the body. The reactive materials may be configured to react in response to colliding with a target. The reactive materials may be configured to explode in response to colliding with a target.

Another embodiment provides a warhead device of an ordnance, the device including a body comprising of a high strength material, where the body includes a plurality of perforations; an explosive material, where the explosive material fills the body; and a plurality of reactive materials, where each reactive material fills a corresponding perforation of the plurality of perforations on the body, where the high strength material is configured to endure an internal stress, a first stress caused by the plurality of reactive materials, and a second stress caused by another component of the ordnance, where the internal stress, the first stress, and the second stress are in response to acceleration of the ordnance.

The warhead device may further include a shock attenuating layer comprising a material configured to mitigate a shock effect, associated with detonating the explosive material, on the body. Each of the plurality of perforations may include a geometrical shape including any of a circular, square, and rectangular shape. The plurality of perforations may be arranged in a pattern configured to maximize a fragment distribution of the body. The plurality of perforations may be arranged in a pattern configured to minimize a stress on the body. The reactive materials may be configured to react in response to colliding with a target. The reactive materials may be configured to explode in response to colliding with a target.

Another embodiment provides a warhead device of an ordnance, the device including a body comprising of a high strength material, where the body includes a plurality of hollow locations; an explosive material, where the explosive material fills the body; and a plurality of reactive materials, where each reactive material fills a corresponding hollow location of the plurality of hollow locations on the body, where the high strength material is configured to endure an internal stress, a first stress caused by the plurality of reactive materials, and a second stress caused by another component of the ordnance, whereas the internal stress, the first stress, and the second stress are in response to acceleration of the ordnance. The plurality of hollow locations may include any of depressions and perforations.

The warhead device may further include a shock attenuating layer including a material configured to mitigate a shock effect, associated with detonating the explosive material, on the body. Each of the plurality of hollow locations may have a geometrical shape including any of a circular, square, and rectangular shape. The plurality of hollow locations may be arranged in a pattern configured to maximize a fragment distribution of the body. The plurality of hollow locations may be arranged in a pattern configured to minimize a stress on the body.

These and other aspects of the embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the exemplary embodiments herein without departing from the spirit thereof, and the embodiments herein include all such modifications.

BRIEF DESCRIPTION OF THE DRAWINGS

The exemplary embodiments herein will be better understood from the following detailed description with reference to the drawings, in which.

DETAILED DESCRIPTION

Figure 1:
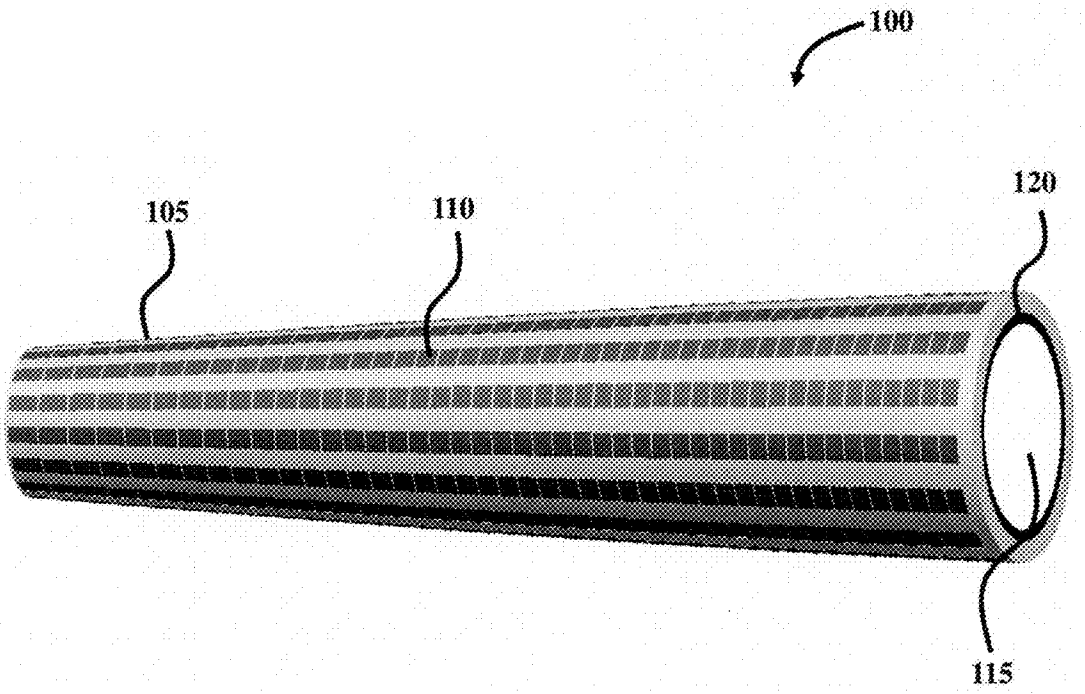
FIG. 1 is a schematic diagram illustrating a warhead according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to, further enable those of skill in the art to practice the embodiments herein. Accordingly, the examples should not be construed as limiting the scope of the embodiments herein.

Reactive materials may cause an energetic reaction upon impact with the target, and may offer increased lethality by increasing the vulnerable area of the target. Reactive materials may be, for example, thermite-like pyrotechnic compositions of two or more nonexplosive solid materials. Reactive materials may stay inert and do not react with each other until they are subjected to a sufficiently strong mechanical, electrical, or laser stimulus. A mechanical stimulus may be for example colliding with the target. After a sufficient stimulus, the reactive materials may undergo fast burning or explosion with release of high amount of chemical energy in addition to their kinetic energy.

For example a reactive fragment impacting fuel tank of a target vehicle may have a high probability of igniting the fuel and causing a catastrophic effect. The increased vulnerable area of the target, coupled with the increased probability of a destructive effect from a fragment impacting that vulnerable area may results in increased warhead lethality.

A limitation associated with reactive materials may be their material strength. Reactive materials generally have low yield strengths that make them unsuitable for implementation in military munitions, which may experience acceleration loads that are tens of thousands times greater than that of gravity. A conventional technology, for example, describes a warhead with the entirety of reactive material. Under high acceleration loads of a warhead, reactive materials may deform and structurally fail, which leads to the loss of the warhead.

The embodiments herein provide an increased lethality warhead for high acceleration environments. Referring now to the drawings, and more particularly to FIGS. 1 through 6, where similar reference characters denote corresponding features consistently throughout the figures, there are shown exemplary embodiments.

FIG. 1 is a schematic that illustrates a warhead device 100 according to an embodiment. Warhead device 100 may be part of an ordnance. Warhead 100 may include a body 105. In an embodiment, the body 105 is made of a high strength material. The high strength material may include metal, metal alloy, or ceramic materials. In an embodiment, the body 105 may have an elongated cylindrical shape. The body 105 may have other three-dimensional geometrical shapes, for example, conical, spherical, ellipsoidal, or any combinations thereof.

Figure 2A:
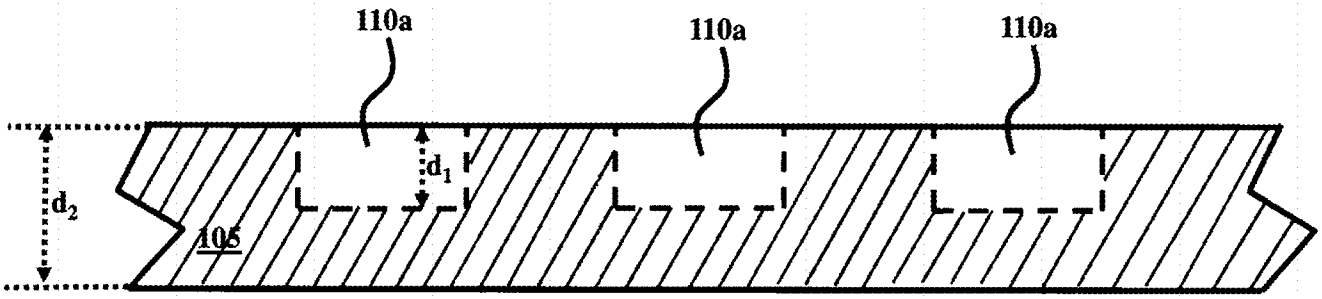
FIG. 2A is a schematic diagram illustrating depressions in a body of a warhead according to an embodiment herein.
Figure 2B:
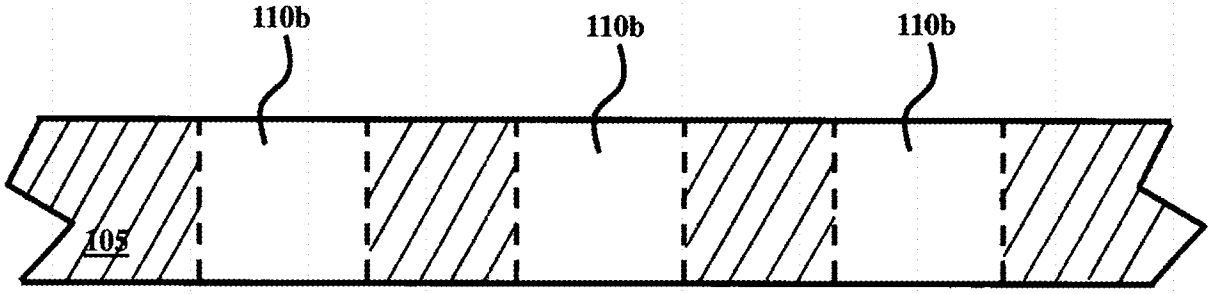
FIG. 2B is a schematic diagram illustrating perforations in a body of a warhead according to an embodiment herein.

In an embodiment, the body 105 is patterned with hollow locations 110. Hollow locations 110 may include any of depressions and perforations. FIG. 2A, with reference to FIG. 1, is a schematic diagram that illustrates a sectional view of a portion of body 105 having depressions 110*a* according to an embodiment. The depressions 110*a* may be dents or engravings in the body 105. Depth $d_1$ of any of the depressions 110*a* may be a value between zero and depth $d_2$ of the body 105. FIG. 2B, with reference to FIGS. 1 through 2A, is a schematic diagram that illustrates a sectional view of a portion of body 105 having perforations 110*b* according to an embodiment. Perforations 110*b* may be holes in the body 105.

Figure 3A:
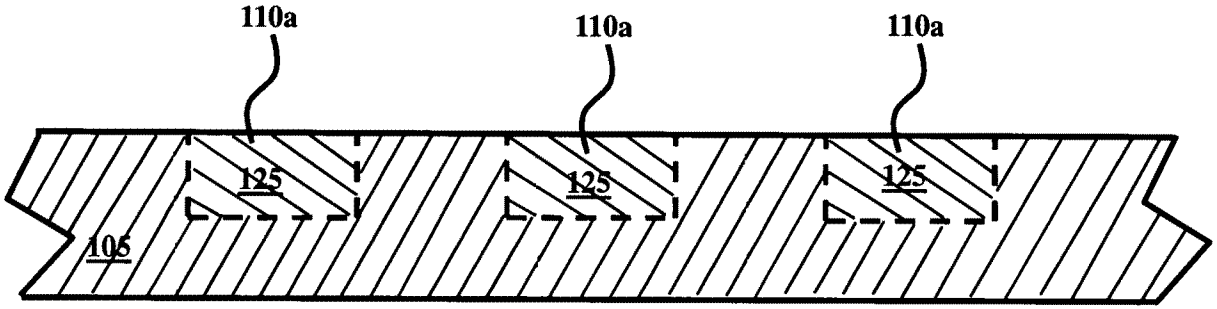
FIG. 3A is a schematic diagram illustrating reactive material in depressions of a body of a warhead according to an embodiment herein.
Figure 3B:
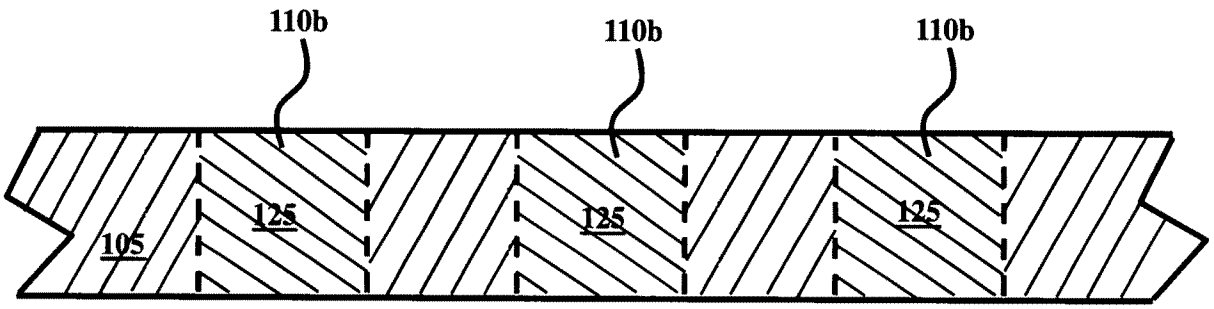
FIG. 3B is a schematic diagram illustrating reactive material in perforations of a body of a warhead according to an embodiment herein.

In an embodiment, each depression or perforation 110 may be filled with reactive materials. FIG. 3A, with reference to FIGS. 1 through 2B, is a schematic diagram that illustrates depressions 110*a* filled with reactive materials 125 according to an embodiment. FIG. 3B, with reference to FIGS. 1 through 3A, is a schematic diagram that illustrates perforations 110*b* filled with reactive materials 125 according to an embodiment.

Figure 4A:
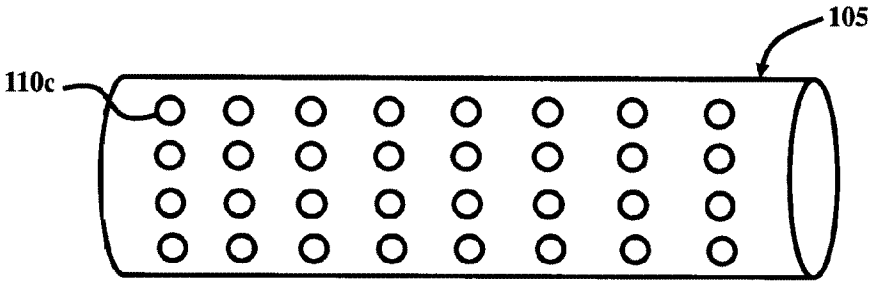
FIG. 4A is a schematic diagram illustrating circular hollow locations in a body of a warhead according to an embodiment herein.
Figure 4B:
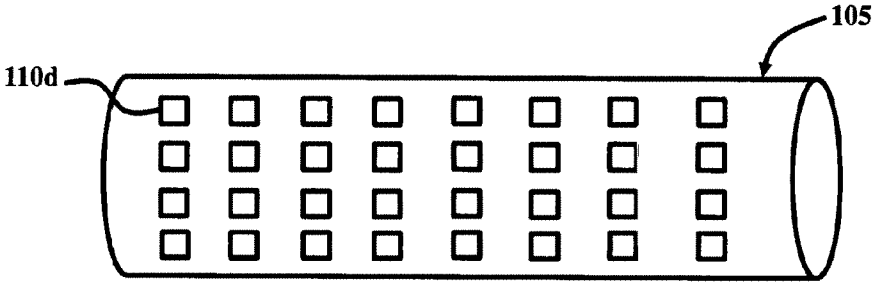
FIG. 4B is a schematic diagram illustrating square hollow locations in a body of a warhead according to an embodiment herein.
Figure 4C:
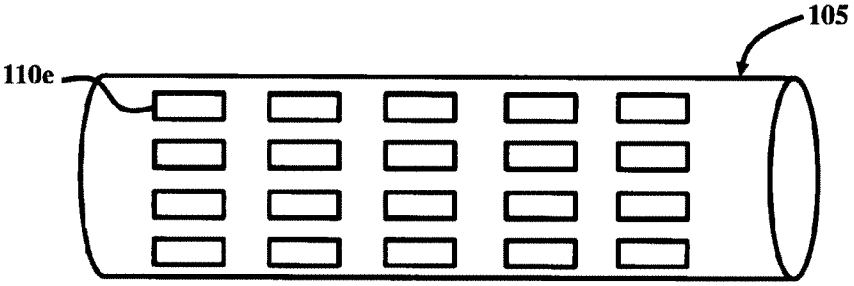
FIG. 4C is a schematic diagram illustrating rectangular hollow locations in a body of a warhead according to an embodiment herein.

Hollow locations 110 may have circular, square, rectangular, triangular, rhombic, or some other geometrical shape so as to best withstand the acceleration loads. FIG. 4A, with reference to FIGS. 1 through 3B, is a schematic diagram illustrating circular hollow locations 110*c* on the body 105, according to an embodiment. FIG. 4B, with reference to FIGS. 1 through 4A, is a schematic diagram illustrating square hollow locations 110*d* on the body 105, according to an embodiment. FIG. 4C, with reference to FIGS. 1 through 4B, is a schematic diagram illustrating rectangular hollow locations 110*e* on the body 105, according to an embodiment.

Hollow locations 110 on the body 105 may have a variety of patterns. The pattern of the hollow locations 110 may vary with different warhead profiles so as to maximize fragment distribution and minimize body stress. The pattern of hollow locations 110 may maximize the fragmentation distribution by dispersing the fragments in a manner that accommodates a unique orientation and circumstances (e.g. velocity, target location) of an ordnance. The pattern of hollow locations 110 may minimize the body stress by avoiding stress concentrations and providing rigid support to column loads.

In an embodiment, the strength of the high strength material of the body 105 is such that the body 105 is capable of enduring not only internal stresses of acceleration, but also the acceleration stresses of the reactive materials 125 acting upon it or any other components in the warhead such as a nose section or other features. Therefore, the reactive material may only need to support itself and does not play a structural role.

In an embodiment, the warhead is filled with an explosive material 115. The physical and performance characteristics of the explosive material 115 may depend on the requirements of the munition. Explosive material 115 may, for example, include pressed or cast plastic-bonded explosives.

In an embodiment, a shock attenuating layer 120 is placed between the explosive material 115 and the body 105. The shock attenuating layer 120 may include shock attenuating material to mitigate the shock effects associated with the detonating explosive on the body material. Shock absorbing material may, for example, include any of polymer linings, and foamed structures made out of metal, polymers, ceramic, or trapped powder layers including metals, polymers, and ceramic.

Figure 5:
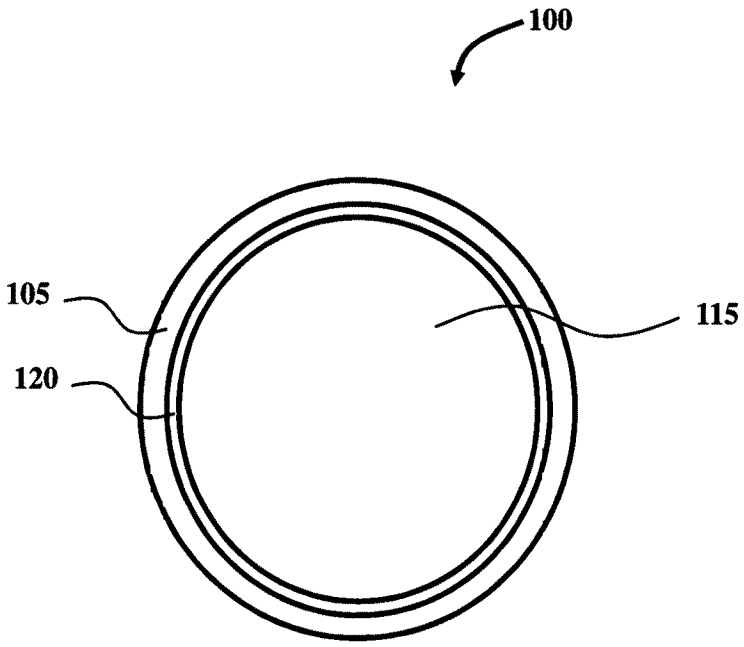
FIG. 5 is a schematic diagram illustrating a cross section of a body of a warhead, according to an embodiment herein.

FIG. 5, with reference to FIGS. 1 through 4C, is a schematic diagram illustrating a cross-section of warhead 100 including explosive material 115, shock attenuation layer 120, and body 105, according to an embodiment.

Figure 6:
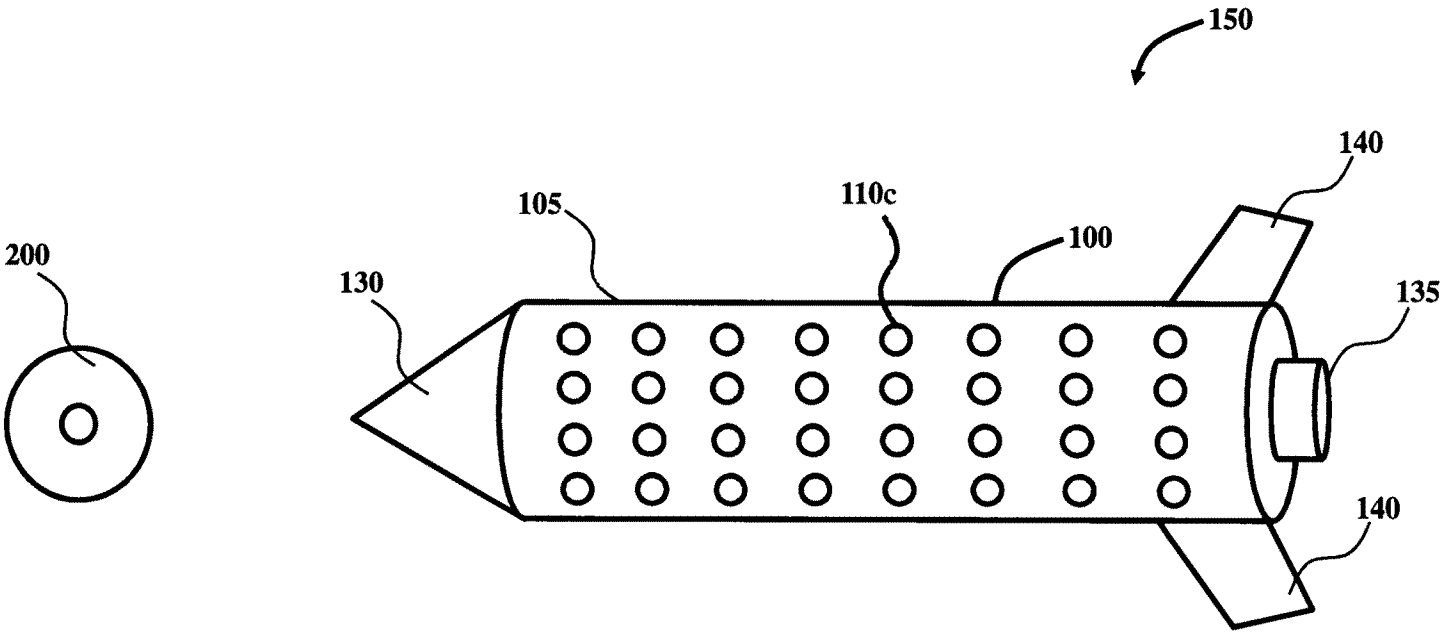
FIG. 6 is a schematic diagram illustrating a warhead according to an embodiment herein.

FIG. 6, with reference to FIGS. 1 through 5, is a schematic diagram illustrating an ordnance 150 including warhead 100 including body 105 and other components, according to an embodiment. The warhead 100 may further include a nose section 130, fuze 135, and fins 140. FIG. 6, as an example of hollow locations 110, shows circular hollow locations 110*c* on the body 105. Body 105 may include any other geometrical shapes or patterns of hollow locations 110.

In an embodiment, the high strength support material in the body 105 may transport reactive material 125 to a target 200. The warhead 100 may function through the detonation of the explosive material 115. The warhead body 105 may be broken apart and the energy of the detonation is imparted into the fragments as kinetic energy. The distinct pockets of reactive materials may break apart into controlled fragments. The combination of inert fragments of body 105 and reactive materials 125 may impact against the target 200 and produce destructive effects that destroy or disable the target 200. An aspect of this embodiment may be the increased lethality offered by the reactive material coupled to the increased survivability of the high strength material of the body 105. In an embodiment, reactive material 125 may increase destructive effect of the warhead by increasing vulnerable area of targets (fuel tanks, rocket motors, munitions, etc). Lastly, in alternate exemplary embodiments, other materials, which are not specifically reactive materials, may be used to fill the depressions 110*a* also referred to as "pockets."

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of exemplary embodiments, those skilled in the art will recognize that the embodiments herein can be practiced with modification within the spirit and scope of the appended claims.

What is claimed is:

1. A warhead device of an ordnance, comprising:

a body comprising a high strength material, wherein said body comprises a plurality of depressions;

an explosive material, wherein said explosive material fills said body; and a plurality of reactive materials, wherein each of said plurality of reactive material fills a corresponding depression of said plurality of depressions on said body, wherein said high strength material is configured to endure an internal stress, a first stress caused by said plurality of reactive materials, and a second stress caused by another component of said ordnance, and wherein said internal stress, said first stress, and said second stress are in response to acceleration of said ordnance.

2. The device of claim 1, further comprising a shock attenuating layer comprising a material being configured for mitigating a shock effect, being associated with detonating said explosive material, on said body.

3. The device of claim 2, wherein each of said plurality of depressions comprises a geometrical shape comprising one of a circular, square, and rectangular shape.

4. The device of claim 2, wherein each of said plurality of depressions comprises a geometrical shape comprising one of a circular, square, and rectangular shape, and wherein said plurality of depressions are arranged in a pattern configured to maximize a fragment distribution of said body.

5. The device of claim 1, wherein said plurality of depressions are arranged in a pattern configured to minimize a stress on said body.

6. The device of claim 5, wherein said plurality of reactive materials are configured to react in response to colliding with a target.

7. The device of claim 5, wherein said plurality of reactive materials are configured to explode in response to colliding with a target.

8. A warhead device of an ordnance, comprising:

a body comprising a high strength material, wherein said body comprises a plurality of perforations;

an explosive material, wherein said explosive material fills said body; and a plurality of reactive materials, wherein each of said plurality of reactive material fills a corresponding perforation of said plurality of perforations on said body, wherein said high strength material is configured to endure an internal stress, a first stress caused by said plurality of reactive materials, and a second stress caused by another component of said ordnance, and wherein said internal stress, said first stress, and said second stress are in response to acceleration of said ordnance.

9. The device of claim 8, further comprising a shock attenuating layer comprising a material being configured for mitigating a shock effect, associated with detonating said explosive material, on said body.

10. The device of claim 9, wherein each of said plurality of perforations comprises a geometrical shape comprising any of a circular, square, and rectangular shape.

11. The device of claim 9, wherein each of said plurality of perforations comprises a geometrical shape comprising any of a circular, square, and rectangular shape, and wherein said plurality of perforations are arranged in a pattern configured to maximize a fragment distribution of said body.

12. The device of claim 9, wherein said plurality of perforations are arranged in a pattern configured to minimize a stress on said body.

13. The device of claim 9, wherein said plurality of perforations are arranged in a pattern configured to minimize a stress on said body, and wherein said plurality of reactive materials are configured to react in response to colliding with a target.

14. The device of claim 9, wherein said plurality of reactive materials are configured to explode in response to colliding with a target.

15. A warhead device of an ordnance, comprising:

a body comprising a high strength material, wherein said body comprises a plurality of hollow locations;

an explosive material, wherein said explosive material fills said body; and a plurality of reactive materials, wherein each of said plurality of reactive material fills a corresponding hollow location of said plurality of hollow locations on said body, wherein said high strength material is configured to endure an internal stress, a first stress caused by said plurality of reactive materials, and a second stress caused by another component of said ordnance, and wherein said internal stress, said first stress, and said second stress are in response to acceleration of said ordnance.

16. The device of claim 15, wherein said plurality of hollow locations comprises any of depressions and perforations.

17. The device of claim 15, further comprising a shock attenuating layer comprising a material being configured for mitigating a shock effect, associated with detonating said explosive material, on said body.

18. The device of claim 17, wherein each of said plurality of hollow locations has a geometrical shape comprising any of a circular, square, and rectangular shape.

19. The device of claim 17, wherein each of said plurality of hollow locations has a geometrical shape comprising any of a circular, square, and rectangular shape, and wherein said plurality of hollow locations are arranged in a pattern configured to maximize a fragment distribution of said body.

20. The device of claim 17, wherein said plurality of hollow locations are arranged in a pattern configured to minimize a stress on said body.

* * * * *